US008662430B2

(12) United States Patent
Lefebvre et al.

(10) Patent No.: US 8,662,430 B2
(45) Date of Patent: Mar. 4, 2014

(54) CONICAL REDUCING APPARATUS

(75) Inventors: Claude Lefebvre, Jouxtens-Mézery (CH); Antoine Virdis, Ferpicloz (CH)

(73) Assignee: Frewitt Fabrique de Machines S.A., Granges-Paccot (CH)

( * ) Notice: Subject to any disclaimer, the term of this patent is extended or adjusted under 35 U.S.C. 154(b) by 229 days.

(21) Appl. No.: 12/972,776

(22) Filed: Dec. 20, 2010

(65) Prior Publication Data

US 2011/0114775 A1 May 19, 2011

Related U.S. Application Data

(63) Continuation of application No. PCT/EP2009/058003, filed on Jun. 25, 2009.

(30) Foreign Application Priority Data

Jun. 26, 2008 (EP) ..... 08159142

(51) Int. Cl.
*B02C 7/00* (2006.01)
*B02C 7/14* (2006.01)

(52) U.S. Cl.
USPC ..... 241/74; 241/36; 241/259.1

(58) Field of Classification Search
USPC ..... 241/259.1, 74, 36
See application file for complete search history.

(56) References Cited

U.S. PATENT DOCUMENTS

| | | | | |
|---|---|---|---|---|
| 188,184 | A * | 3/1877 | Powers | 241/258 |
| 2,846,155 | A * | 8/1958 | Higer | 241/46.017 |
| 5,330,113 | A | 7/1994 | Poser et al. | |
| 5,522,559 | A * | 6/1996 | Bredbeck | 241/259.1 |
| 5,863,004 | A * | 1/1999 | Broillet | 241/74 |
| 7,543,769 | B2 * | 6/2009 | Shimizu et al. | 241/37 |

FOREIGN PATENT DOCUMENTS

| | | |
|---|---|---|
| DE | 1141517 B | 12/1962 |
| DE | 3617175 A1 | 12/1986 |

OTHER PUBLICATIONS

International Search Report for PCT/EP2009/058003 dated Jun. 11, 2010.

* cited by examiner

*Primary Examiner* — Faye Francis
(74) *Attorney, Agent, or Firm* — Pearne & Gordon LLP

(57) ABSTRACT

A crusher device for performing a crushing operation, including a hollow part of frusto-conical shape narrowing downwardly, a crusher spindle rotatably mounted coaxial with the hollow part, at least one crusher impeller rotatably mounted on the crusher spindle, and a crusher driving device for rotatably driving the at least one crusher impeller relative to the first hollow part; the at least one crusher impeller comprises a first crusher impeller containing a first crushing blade and a second crushing blade, each of the first and second crushing blades extending radially from the crusher spindle and being fixedly connected to each other at their distal extremities by a blade member. The crusher device can be combined with a milling device providing an apparatus of compact size, adapted for reducing material from a size up to 36000 $cm^3$ to particles having a size below 250 microns.

18 Claims, 8 Drawing Sheets

CONICAL REDUCING APPARATUS

FIELD OF THE INVENTION

The present disclosure relates to an apparatus for reducing the size of large material lumps into fine particles.

DESCRIPTION OF RELATED ART

The process of milling solid blocks into small particles suitable for manufacturing downstream operations is a redundant challenge for many industries. This challenge is usually addressed by using cascade of different equipments, each piece of equipment providing the milled material to a certain size reduction and feeding this material to the next piece of equipment in order to continue the milling process until the particle size has been attained.

Generally, coarse blocks of about 50 cm in size and above are processed on a minimum of two equipments in order to reach approximately particles with a diameter of the order of 500 μm. A crusher is commonly used as a first step in the milling process.

Because of their design, geometry and operation, the different equipments cannot be easily integrated in an in-line process. In addition, they can be difficult to clean after completion of a milling process of a given material or product. Proper cleaning is a crucial issue especially in the pharmacy, biotechnology and fine chemical industries which require production process to follow good manufacturing practices in order to avoid cross contamination between the different materials processed. Proper cleaning often required to be performed off-site.

DE1141517 discloses an apparatus for cutting up, mixing and homogenize material mixtures comprising a crushing device disposed above a milling device comprising a sieve having a frusto-conical shape. The crusher device and the milling device are connected via a connecting part destined to provide holes used to homogenize the crushed products coming from the crusher device.

DE3617175 describes a device for comminuting and screening a dry material and comprising a comminuting element disposed above and connected to a milling device.

U.S. Pat. No. 5,330,113 discloses a milling device for use in process industries to continuously and precisely reduce the size of particles, while controlling fines, comprises an impeller mounted on a rotatable shaft, a drive operably connected to the shaft for effecting rotation of the shaft. The shaft and impeller are vertically mounted within a vertically extending channel having an input and an output. A screen has a tapered apertured wall formed in a frusto-conical shape. The screen is rigidly mounted within the channel so that any particles passing from the input to the output pass through the screen.

A milling device allowing for an easy and in-place cleaning, that could be smaller and more modular for multi-product manufacturing is still wanted.

BRIEF SUMMARY OF THE INVENTION

The above limitations of prior art can be overcome with a crusher device and an apparatus for reducing material as disclosed herein.

According to the embodiments, a crusher device for reducing the size of material, can comprise a hollow part of frusto-conical shape narrowing downwardly, a crusher spindle rotatably mounted coaxial with the hollow part, at least one crusher impeller rotatably mounted on the crusher spindle, and a crusher driving device for rotatably driving said at least one crusher impeller relative to said first hollow part; wherein said at least one crusher impeller can comprise a first crusher impeller containing a first crushing blade and a second crushing blade, each said first and second crushing blades extending radially from the crusher spindle and being fixedly connected to each other at their distal extremities by a blade member.

In an embodiment, said first crusher impeller can comprise a third crushing blade extending radially from the crusher spindle, below the first and second crushing blades.

In another embodiment, said first crusher impeller can further comprise an unbalancing blade to impede the material lump rotating with the first impeller.

In yet another embodiment, said first crushing blade and second crushing blade can be offset angularly.

In yet another embodiment, said first and second crushing blades can comprise a sharpened cutting edge. The cutting edge can further comprise serrations along at least a portion of the cutting edge.

In yet another embodiment, said first crusher impeller can further comprise a fourth crushing blade extending radially and downward from the crusher spindle, below the third crushing blade.

In yet another embodiment, said crusher device can further comprises a second crusher impeller. The second crusher impeller can comprise an outer ring mounted rotatably and coaxially on the crusher spindle, said outer ring containing one or several outer crushing teeth along its periphery. Alternatively, the second crusher impeller can further comprise an inner ring fixed to the outer ring and rotating with it, said inner ring containing one or several inner crushing teeth along its periphery.

In yet another embodiment, said outer and inner rings can contain three outer and three inner crushing teeth, respectively.

In yet another embodiment, the crusher device can comprises at least one static element to impede possible rotation of the material to be crushed with said at least one crusher impeller. Said at least one static element can comprise one or several stator elements fixed on the hollow part, above the first crusher impeller, or one or several static blades fixed on the crusher driving element, or one or several lower stator elements arranged radially around the lower end of the hollow part, or the crusher driving element.

In yet another embodiment, said crusher device can further comprises a torque detection device able to detect a predetermined high torque value of the crusher spindle, said torque detection device controlling the crusher driving device to adjust the rotation speed and/or rotation direction of the crusher spindle when the predetermined high torque value is detected.

The present disclosure also pertains to an apparatus for reducing the size of material, comprising a milling device containing a sieve and a milling impeller, said milling impeller being rotated relative to the interior wall surface of the sieve, said sieve having a frusto-conical shape narrowing downwardly, and said milling impeller is vertically mounted within the sieve; and the crusher device; wherein the crusher device being connectable to the milling device such that the frusto-conical shape of the sieve of the milling device extends the frusto-conical shape of the hollow part of the crusher device.

In an embodiment, the milling spindle can be mounted on a rotatable milling spindle, the milling spindle being rotatably driven by the crusher spindle.

In another embodiment, the milling spindle can be rotatably driven by the fourth crushing blade.

In another embodiment, said milling impeller can be rotated relative to the interior wall surface of the sieve such that during a reducing operation, said material is first crushed by the crusher device by rotating said at least one crusher impeller, and milled by the milling device by rotating the milling impeller.

The apparatus disclosed herein can be manufactured at low cost and is of compact size. Using the disclosed apparatus, material having a size up to 36000 $cm^3$ can be reduced effectively to particles having a size below 250 microns in diameter.

BRIEF DESCRIPTION OF THE DRAWINGS

The preferred embodiments will be better understood with the aid of the description of each embodiment given by way of example and illustrated by the figures, in which.

DETAILED DESCRIPTION OF POSSIBLE EMBODIMENTS OF THE INVENTION

Figure 1:
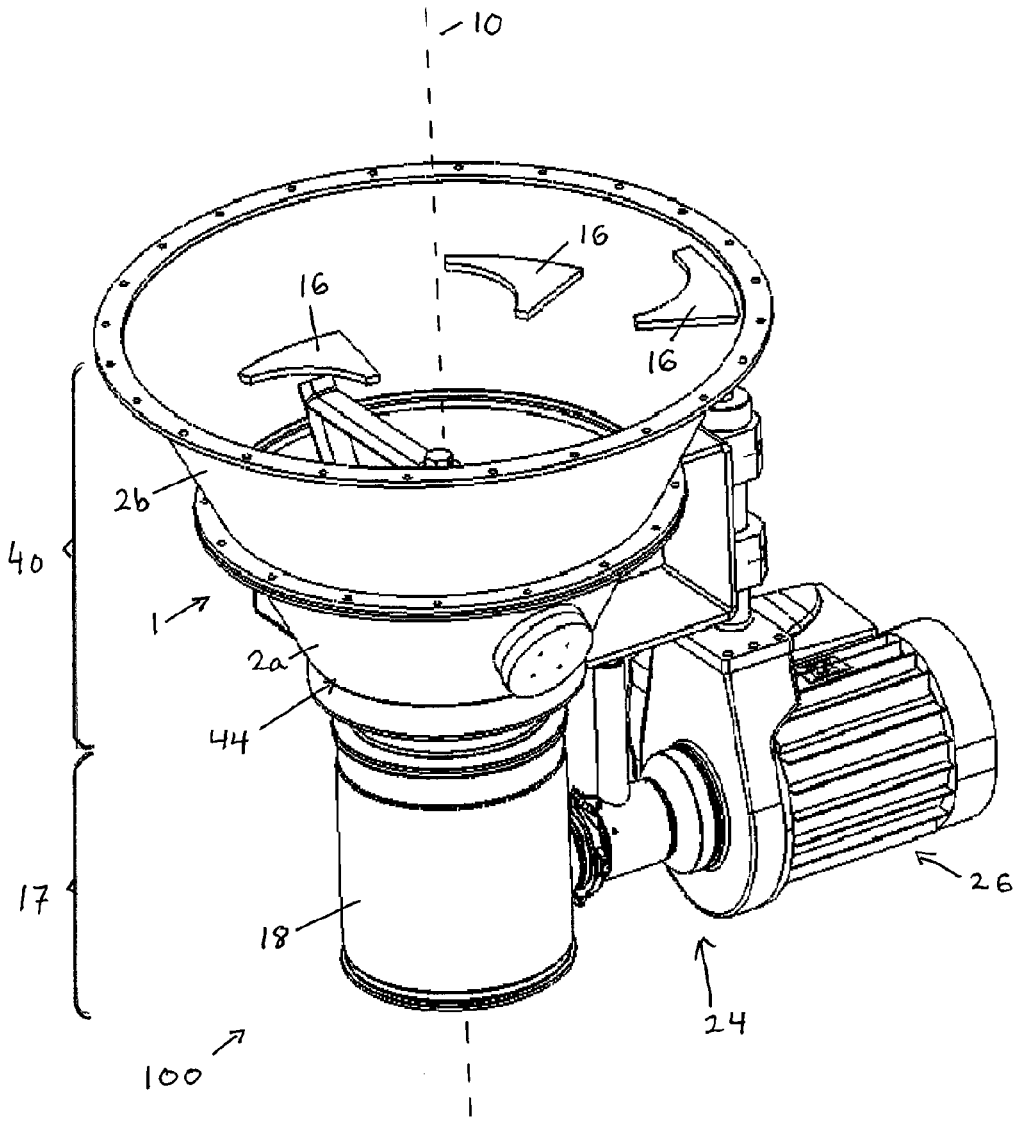
FIG. 1 is a side view of a system comprising an apparatus comprising a crusher device and a milling device according to an embodiment of the invention.
Figure 2:
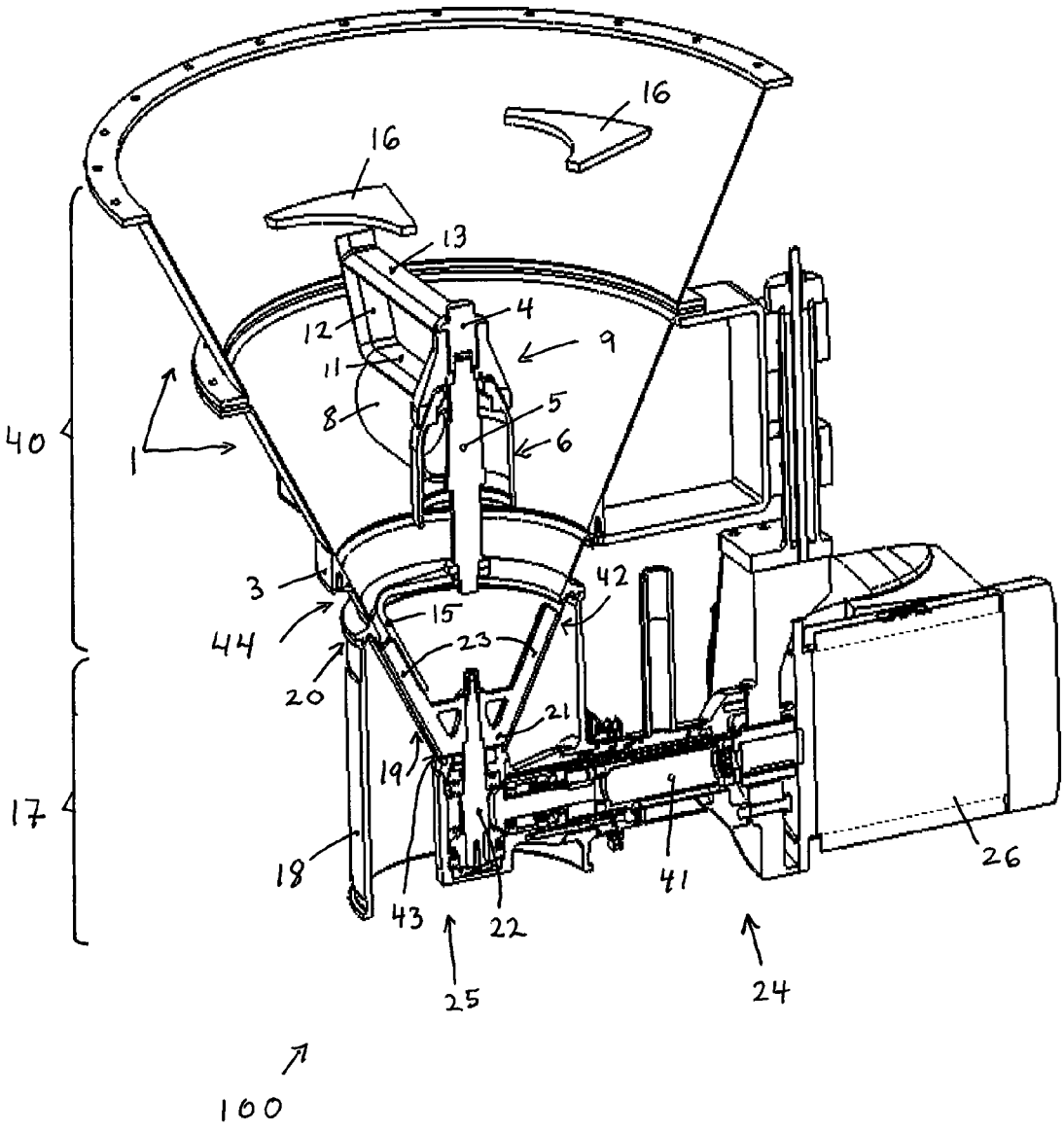
FIG. 2 is a cross-section view of the apparatus of FIG. 1, according to a cut made in the vertical plan.

A side view of an apparatus 100 for reducing the size of material according to an embodiment of the invention is shown in FIG. 1, while a cross-section view of the apparatus 100 is shown in FIG. 2 according to a cut made in the vertical plan of the FIG. 1.

The apparatus comprises a crusher device 40 comprising a hollow part 1 having the shape of a truncated cone revolving around a crusher axis 10, and narrowing downwardly toward a lower end 44. In the example of FIGS. 1 and 2, the hollow part 1 consists of a first hollow part 2*a* and a second hollow part 2*b*, the second hollow part 2*b* being fixedly connected to the first hollow part 2*a*, extending upward the first hollow part 2*a*. The shape of the hollow part 1, or second hollow part 2*b*, is advantageous for introducing the material to be reduced into the crusher device 40, and has other functionalities that will be described below. The crusher device 40 further comprises a crusher spindle 5 rotatably mounted coaxial with the hollow part 1, a crusher rotor 4 and a first crusher impeller 9 rotatably mounted on the crusher spindle 5.

The crusher spindle 5 is driven by a crusher driving device comprising a crusher motor 7 (partially shown in FIG. 3) drivingly connected to the crusher spindle 5 via a gearbox 6, enclosing the spindle 5, and a crusher driving element 8. In the example of FIG. 2, the crusher driving element 8 extends radially between the hollow part 1 and the gearbox 6.

Other arrangements of the crusher driving device are also possible. For example, the crusher driving element 8 can extend coaxially with the crusher spindle 5. Such arrangement does not necessitate the use of the gearbox 6.

In an embodiment of the invention shown in FIG. 2, the first crusher impeller 9 comprises a first and a second crushing blade 11, 13, both blades 11, 13 extending radially from the crusher spindle 5 and being fixedly connected to each other at their distal extremities, toward the hollow part 1, by a blade member 12. Preferably, the blade member 12 is inclined substantially parallel to the wall of the hollow part 1, producing a constant gap between the blade member 12 and the internal wall of the hollow parts 1. Other inclination angles of the blade member 12 are however possible.

Figure 5:
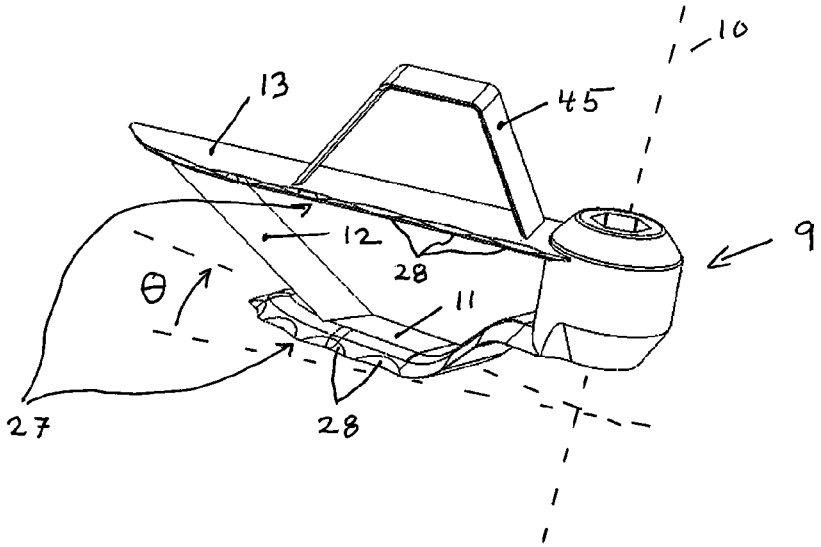
FIG. 5 illustrates a first crusher impeller of the apparatus according to an embodiment.

In a variant of the embodiment represented in FIG. 5, the first and second crushing blades 11, 13 are offset with an angle θ, where θ can have any value comprised between 0 and 90°. This configuration minimizes the risk that a lump of material remains blocked between the two crushing blades 11, 13 and rotates with the first crusher impeller 9, preventing effective crushing of the material.

In another variant of the embodiment also represented in FIG. 5, the first and second crushing blades 11, 13 have a sharpened cutting edge 27, diminishing the contact surface between the crushing blades 11, 13 and the material to be crushed, and thus increasing the pressure exerted on the material by the crushing blades 11, 13. This results in an increased crunching efficiency, mainly due to the increased penetration of the crushing blades 11, 13 and enhanced crack initiation in the material. Preferably, at least a portion of the cutting edge 27 of the first and/or the second crushing blades comprises serrations 28. As shown in FIG. 5, the first crusher impeller 9 can further comprise an unbalancing blade 45 fixed on top of the second crushing blade 13. The unbalancing blade 45 allows avoiding the material lump to sit and rotate with the first crusher impeller 9 without being crushed, when introduced into the crusher device 40.

Figure 3:
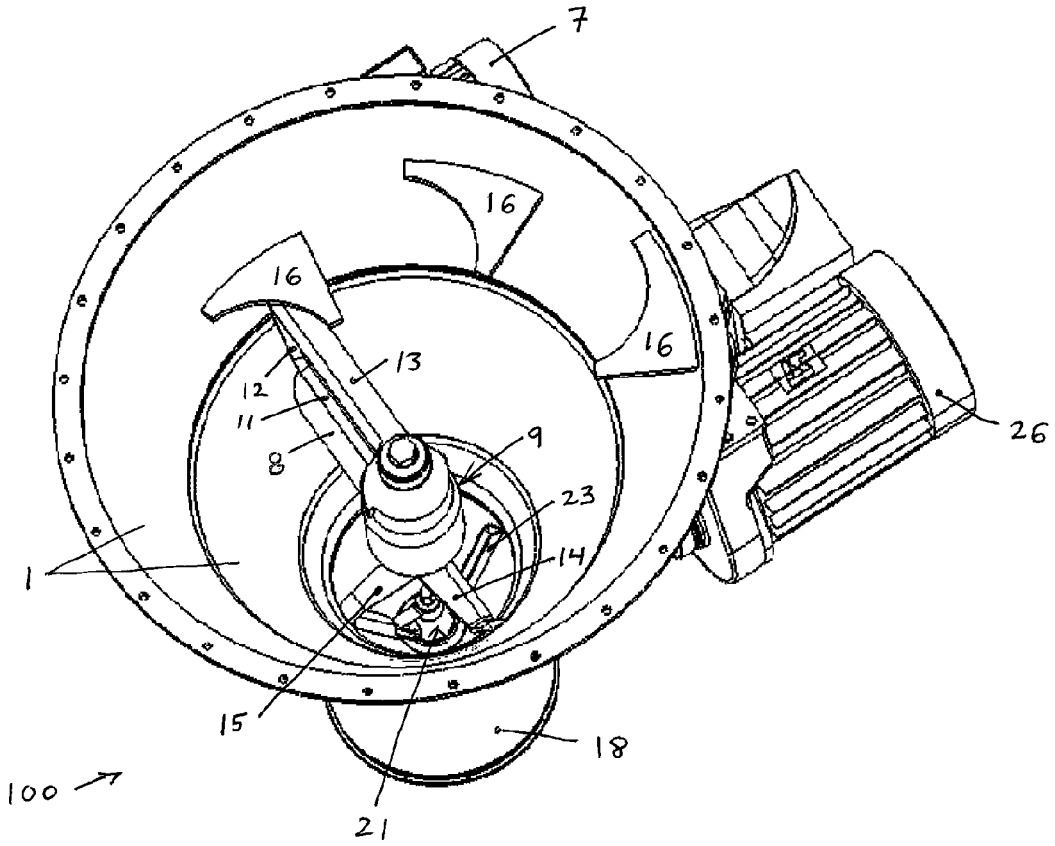
FIG. 3 shows the apparatus of FIG. 1 viewed in perspective from above according to an embodiment.
Figure 4:
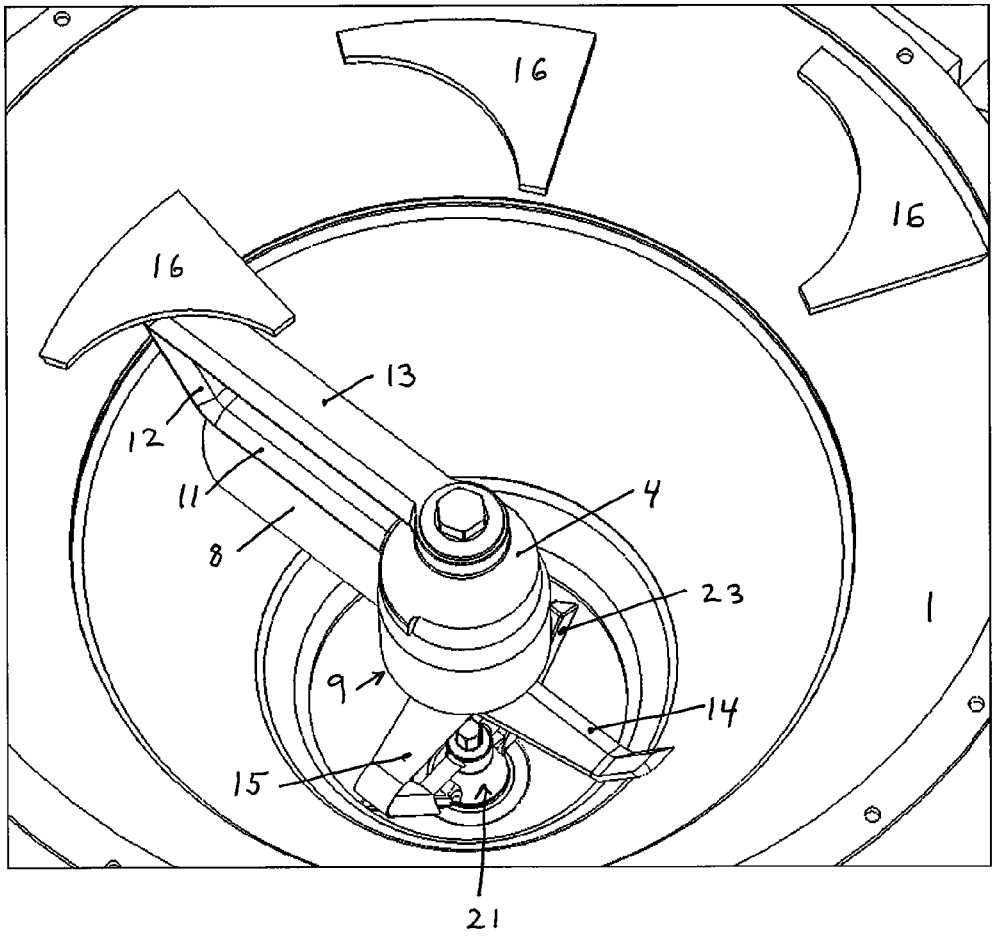
FIG. 4 is a close view of the FIG. 3.

In another embodiment illustrated in FIGS. 3 and 4 showing a the apparatus 100 viewed in perspective from above (FIG. 4 showing a partial view), the first crusher impeller 9 comprises a third crushing blade 14 extending radially from the first rotor 4, below the first and second crushing blades 11, 13. The third crushing blade 14 can improve the crushing efficiency by crushing further fragments of material produced by the first and second crushing blades 11, 13. Preferably, the third crushing blade 14 has a distal end oriented upward possibly inclined substantially parallel to the hollow part 1. The first crusher impeller 9 can also comprise a fourth crushing blade 15 extending radially, below the third crushing blade 14. Preferably, the distal end of fourth crushing blade 15 is bended downward. The fourth crushing blade 15 can be used to further enhance the crushing of the fragments of material produced by the first and second blades 11, 13, and possible by the third crushing blade 14.

The first crusher impeller 9 can be formed from a single piece. However, the first and second crushing blades 11, the blade member 12, and the crusher rotor 4 can also be made from separate parts assembled by welding or any other suitable means.

Figure 6:
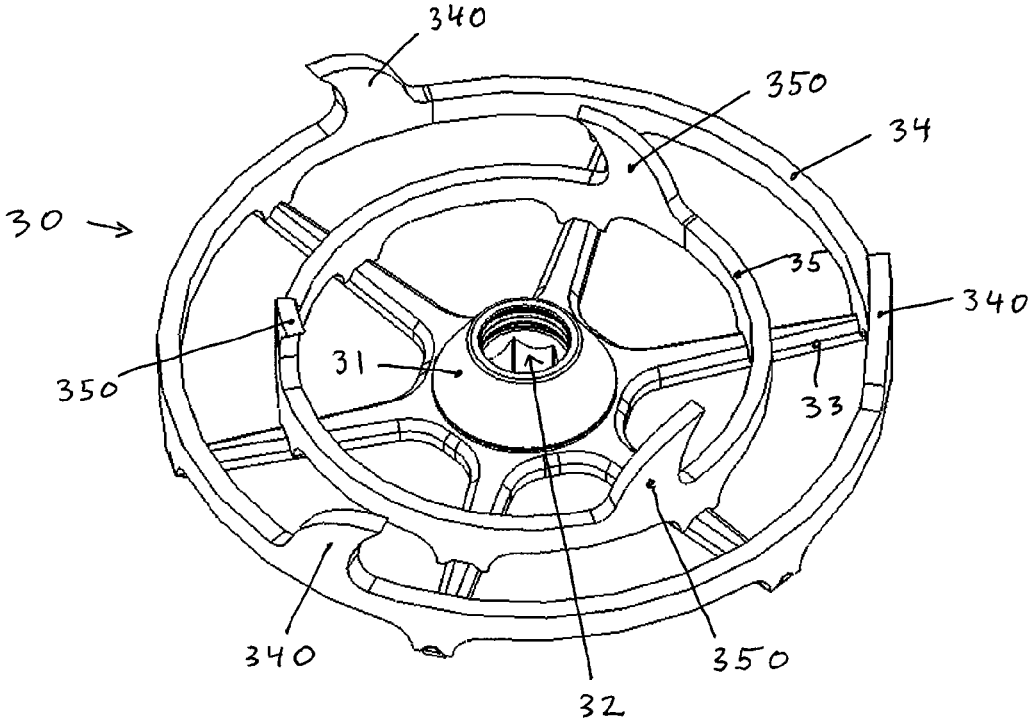
FIG. 6 illustrates a second crusher impeller according to an embodiment.
Figure 7:
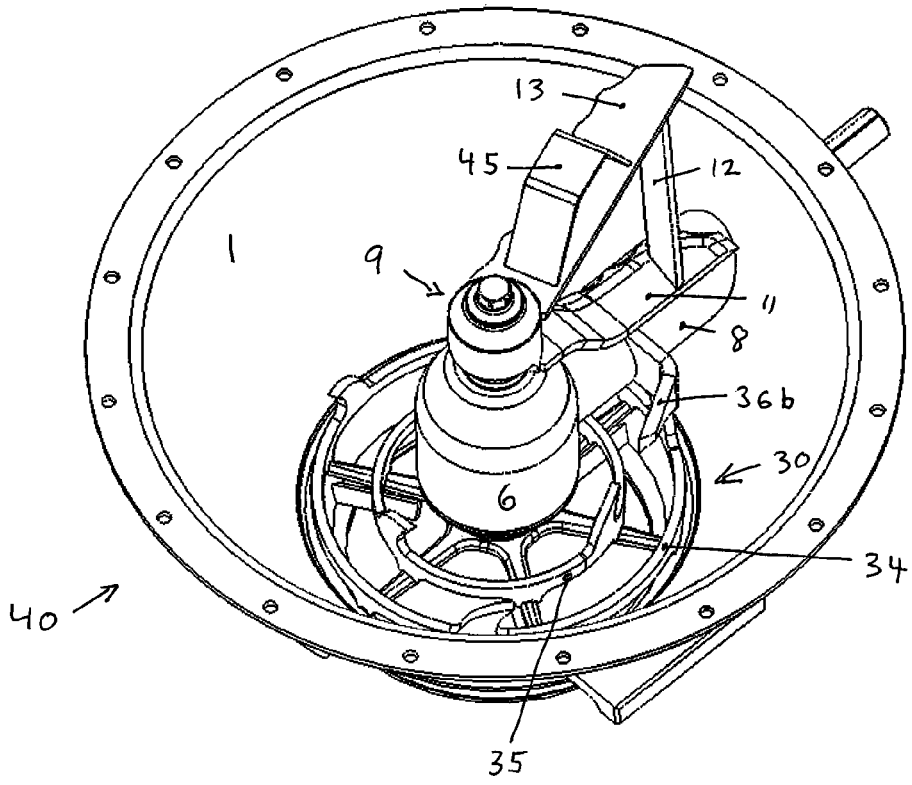
FIG. 7 shows the apparatus of FIG. 1 viewed in perspective from above according to another embodiment.

In another embodiment represented in FIGS. 6 and 7, the crusher device further comprises a second impeller 30 formed from an outer ring 34 containing one or several outer crushing teeth 340. In the example of FIG. 6, the outer ring 34 is fixedly attached to a second impeller rotor 31 by six arms 33 extending radially from the rotor 31 to the outer ring 34. Any other attachment means are however possible including a disc containing openings sufficiently large to let crushed material fragments pass through them. The second impeller 30 is mounted rotatably and coaxially on the crusher spindle 5 by driving an aperture 32 provided on the rotor 31 onto the crusher spindle 5. Preferably, the number of outer crushing teeth 340 is chosen such as, during the crushing operation, the material to be crunched is seized by only one tooth at a given time. In the example of FIG. 6, the outer ring 34 comprises three outer crushing teeth 340 oriented upward and equally distributed, along the outer ring periphery.

In a variant of the embodiment also represented in FIGS. 6 and 7, the second impeller 30 further comprises an inner ring 35 containing one or several inner crushing teeth 350, the inner ring 35 being fixed to the outer ring 34 and rotating with it. In the example of FIG. 6, the inner ring 35 contains three inner crushing teeth 350 oriented upward and equally distributed, along the inner ring periphery. The outer and inner rings 34, 35 of the second impeller 30 can be made from separate parts assembled by welding or any other suitable means. However, the second impeller 30 is preferably made from a single piece.

The second impeller 30 is preferably rotatably mounted on the lower extremity of the crusher spindle 5, in the vicinity of the lower end 44 of the hollow part 1, as shown in the example of FIG. 7 representing a perspective view of the crusher device 40.

The crusher device 40 can comprise a static device able to impede possible rotation of the material with first and/or second impeller 9, 30. Indeed, during the crushing operation, large material lumps can be carried by the first and/or second impeller 9, 30, and start rotating with them. In this case, the material cannot be crushed effectively. Here, the static device can be used to impede the rotation of the material and force the first and/or second impellers 9, 30 to break to material, thus enhancing the crushing efficiency.

In an embodiment shown in FIGS. 2 to 4, the static device comprises one or several stator elements 16 fixed on the internal wall of the hollow part 1. In FIGS. 2 to 4, the stator elements 16 can be seen extending radially toward the crusher axis 10. More particularly, in FIGS. 2 to 4 three stator elements 16 are fixed on the upper end of the hollow part 1, above the first crusher impeller 9.

Figure 8:
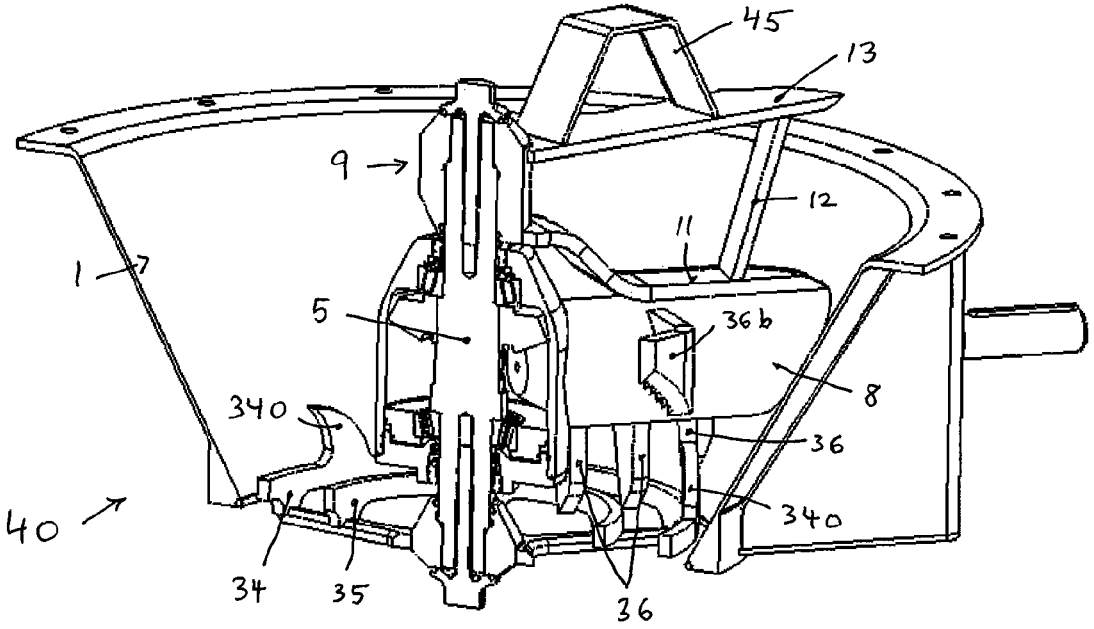
FIG. 8 represents a cross-section view of the crusher according to another embodiment.

In another embodiment shown in FIG. 8, the static device comprises one or several static blades 36 fixed on the crusher driving element 8. Preferably, the static blades 36 are fixed on the lower side of the crusher driving element 8 in a configuration allowing the outer and inner crushing teeth 340, 350 of the second crusher impeller 30 to pass sequentially between the static blades 36 when the second impeller 30 rotates. By blocking possible rotation of the material fragments around the crusher axis 10, the static blades 36 advantageously force the outer and/or inner crushing teeth 340, 350 to seize the material and break it, thus, increasing the crushing efficiency. In a variant of the embodiment, one or several additional static blades 36*b* can be fixed on the lateral side if the crusher driving element 8 as shown in the example of FIG. 8.

Figure 9:
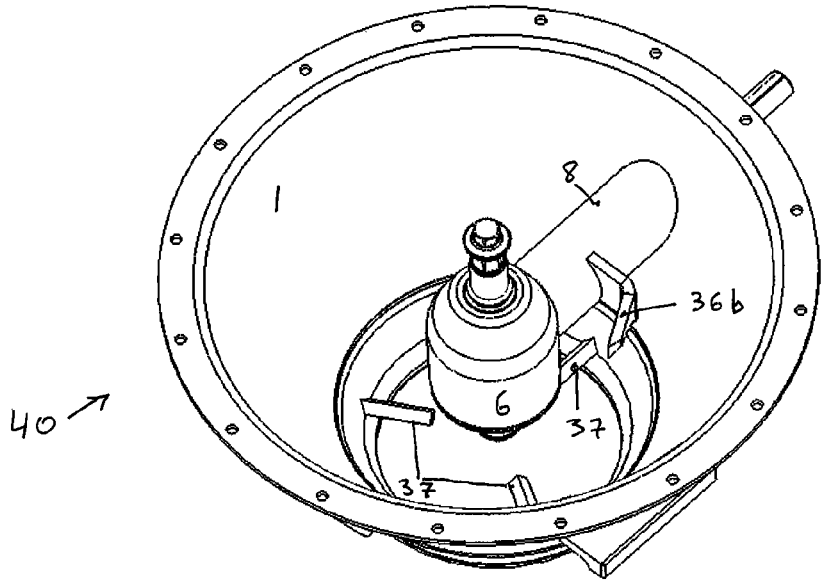
FIG. 9 shows the apparatus of FIG. 1 viewed in perspective from above according to yet another embodiment.

In yet another embodiment illustrated in FIG. 9, the static device comprises one or several lower stator elements 37 fixed radially around the periphery of the internal wall of the lower part of the hollow part 1, for example, around the lower end 44. Preferably, three lower stator elements 37 are arranged equally spaced. The lower stator elements 37 can be advantageous used to improve fine crushing efficiency, in particular with slippery materials such as ice.

The apparatus 100 further comprises a milling device 17, formed from a sieve 19 and a tubular frame 18 in which the sieve 19 is coaxially mounted. The sieve 19 has a frusto-conical shape narrowing downwardly, with an open upper wide end 42 and a lower narrow end 43 being at least partially closed. In most uses, it is desirable to have the lower narrow end 43 completely closed. The milling device 17 further comprises a milling impeller 21 mounted on a rotatable milling spindle 22, both milling impeller 21 and milling spindle 22 being vertically mounted within the sieve 19. In the preferred embodiment of FIG. 2 the milling impeller 21 comprises two symmetrical milling blades 23. However, the milling impeller 21 can comprises several blades 23 equally distributed around the milling rotor 21 or distributed according to any other arrangement. Preferably, a constant gap is formed between the peripheral edge of the milling blade 23 and the interior wall of the sieve 19. The milling impeller 21 rotates relative to the interior wall surface of the sieve 19 for milling the material inputted from the upper wide end 42 by passing said material through the sieve 19. The milled material is then leaves the milling device 17 by an exit 25. Such a milling device is described in more details in U.S. Pat. No. 5,863,004 by the present applicant.

The milling device 17 is susceptible to various modifications and alternative forms. For example, the sieve 19 can be disk-shaped or have a tubular shape, with the milling blade 23 rotating relative to the disk-shaped or tubular-shaped sieve 19, respectively.

In an embodiment illustrated in FIGS. 1 to 3, the milling device 17 is connected below the crusher device 40, the upper wide end 42 of the sieve 19 being vertically connected to the lower end 44 of the hollow part 1. More particularly, the hollow part 1 of the crusher device 40 can be connected to the sieve 19, by connecting a lower flange 3, comprised at the lower end 44 of the hollow part 1, to an upper flange 20, comprised on the upper side of the tubular frame 18. Preferably, the milling device 17 is connected coaxially with the crusher device 40. In this configuration, the conical sieve 19 of the milling device 17 is prolonged by the conical-shaped hollow part 1 of the crusher device 40.

The milling rotor 21 can be driven by connecting the fourth crushing blade 15 to the milling impeller 21, for example, by one of the milling blades 23, as shown in FIG. 2. Alternatively, the milling spindle 22 can be connected to the crusher spindle 5.

In another embodiment also represented in FIG. 2, the milling impeller 21 is driven by a milling driving device 24 comprising a milling motor 26 and a milling driving element 41, the milling driving device 24 driving the milling spindle 22.

In a preferred embodiment, the different parts of the crusher device 40 and of the milling device 17 are made in stainless steel to make the apparatus 100 compatible for use in a sanitary environment such as in pharmaceutical applications.

During a reducing operation using the apparatus 100, the material is inputted into the hollow part 1 and is crushed by the action of the first and/or second crusher impeller 9, 30. This crushing operation produces crushed material fragments that enter, by gravity, the milling device 17 disposed below the crusher device 40. The crushed material is then milled in the milling device 17 by being pressed through the sieve 19 when the milling impeller 21 is rotated. The milled material, having the form of fine particles, leaves the milling device 17 through the output 25.

The crushing efficiency can be increased by using the second impeller 30 and/or by using the static device according to any of the embodiments disclosed herein. For example, in a configuration of the crusher device 40 comprising the second impeller 30 and the static blades 36, the combined action of the second impeller 30 with the static blades 36 produces a flux of crushed material entering the milling device 17 that is more regular than in the absence of the second impeller 30.

Moreover, using the second impeller 30, the crushed material entering the milling device 17 is less likely to escape the milling device 17 toward the crusher device 40 under the action of the centrifugal forces.

Using the apparatus 100 and the reducing operation disclosed herein, and rotating the first and/or second crusher impeller 9, 30 at a rotation speed comprised typically between 5 t/min and 50 t/min, and rotating the milling impeller 21 at a rotation speed comprised typically between 300 t/min to 1500 t/min, large material lump, for example, material lumps having a size up to 60×40×15 cm, or up to 36000 $cm^3$, can be reduced to fine particles having a size down to 250 μm, in a single reducing operation.

Since the crusher device 40 is of simple construction and contains no sieve, the device 40 is very easy to clean, even allowing for easy cleaning-in-place (CIP) and washing-in-place (WIP) processes.

Due to its conical shape and the geometry if the first and/or second crusher impeller 9, 30, the crusher device 40 is able to prevent clogging of powder materials and/or can be used for disagglomeration of materials that have become hardened and lumpy over time and sizes them into free-flowing powder.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

For example, in an embodiment not represented, the crusher device 40 further comprises a torque detection device able to detect a predetermined high torque value of the crusher spindle 5. Such high torque value of the crusher spindle 5 can correspond, for example, to the first and/or second impeller 9, 30 being jammed by hard material fragments. Here, the torque detection device can control the crusher driving device, or the crusher motor 7, and adjust the rotation speed and/or rotation direction of the crusher spindle 5 when the predetermined high torque value is detected. For example, upon detection of the predetermined high torque, the first and/or second impellers 9, 30 can be halted, and/or the rotation of the first and/or second impellers 9, 30 can be inversed during a predetermined time period, in order to release the impellers 9, 30. After releasing, the impellers 9, 30 can be rotated to their normal crushing rotation speed and direction to carry on with the crushing operation.

In another embodiment not represented, the apparatus 100 further comprises a weight metering device able to measure, possibly continuously, a weight of the milled material. The weight metering device can be a gravimetric measurement instrument such as a balance, disposed below the milling device 17 and receiving the material milled by the milling device 17. The weight metering device can possibly control the milling driving device 24, or the milling motor 26, in order to adjust the rotation speed of the milling spindle 22, or milling impeller 21, as a function of a predetermined weight set point. For example, the weight metering device can set a lower rotation speed of the milling impeller 21 when the weight set point corresponds to a lower milling material weight, than when the weight set point corresponds to a higher milling material weight.

REFERENCE NUMBERS

1 hollow part
100 Apparatus
2*a* first hollow part
2*b* second hollow part
3 lower flange of the hollow part
4 crusher rotor
5 Spindle
6 Gearbox
7 crusher motor
8 crusher driving element
9 first crusher impeller
10 crusher axis
11 first crushing blade
12 blade member
13 second crushing blade
14 third crushing blade
15 fourth crushing blade
16 stator element
17 milling device
18 tubular frame
19 Sieve
20 upper flange
21 milling impeller
22 milling spindle
23 milling blade
24 milling driving device
25 exit of the milling device
26 milling motor
27 cutting edge
28 serrations of the first and second crushing blades
30 second crusher impeller
31 second impeller rotor
32 Aperture
33 arms of the second impeller
34 outer ring
340 outer crushing teeth
35 inner ring
350 Inner crushing teeth
36 static blades
36*b* additional static blade
37 lower stator element
40 crusher device
41 milling driving element
42 upper wide end of the sieve
43 lower narrow end of the sieve
44 lower end of the hollow part
45 unbalancing blade

We claim:

1. A crusher device for performing a crushing operation, comprising;

a hollow part of frusto-conical shape narrowing downwardly and terminating in an output through which crushed material exits in a direction substantially parallel to the axis of the hollow part, a crusher spindle rotatably mounted coaxially with the hollow part, at least one crusher impeller rotatably mounted on the crusher spindle, and a crusher driving device for rotatably driving said at least one crusher impeller relative to said hollow part;

wherein said at least one crusher impeller comprises a first crushing blade and a second crushing blade, each of said first and second crushing blades extending radially from a different lateral position along the crusher spindle and being fixedly connected to each other at their distal extremities by a blade member, and wherein the hollow part is configured so that substantially all crushed material fragments can fall through the output.

2. The crusher device according to claim 1, wherein said first crushing blade and second crushing blade are offset angularly.

3. The crusher device according to claim 1, wherein said first crusher impeller comprises a third crushing blade extending radially from the crusher spindle, below the first and second crushing blades.

4. The crusher device according to claim 1, wherein said first crusher impeller further comprises an unbalancing blade to impede the material lump rotating with the first impeller.

5. The crusher device according to claim 3, wherein said first crusher impeller further comprises a fourth crushing blade extending radially and downward from the crusher spindle, below the third crushing blade.

6. The crusher device according to claim 1, wherein said crusher device further comprises a second crusher impeller.

7. The crusher device according to claim 6, wherein said second crusher impeller comprises an outer ring mounted rotatably and coaxially on the crusher spindle, said outer ring containing one or several outer crushing teeth along its periphery.

8. The crusher device according to claim 7, wherein said second crusher impeller further comprises an inner ring fixed to the outer ring and rotating with it, said inner ring containing one or several inner crushing teeth along its periphery.

9. The crusher device according to claim 8, wherein said outer and inner rings can contain three outer and three inner crushing teeth, respectively.

10. The crusher device according to claim 1, wherein the crusher device comprises at least one static element to impede possible rotation of the material to be crushed with said at least one crusher impeller.

11. The crusher device according to claim 10, wherein said at least one static element comprises one or several stator elements fixed on the hollow part above the first crusher impeller.

12. The crusher device according to claim 10, wherein said at least one static element comprises one or several lower stator elements arranged radially around the lower end of the hollow part.

13. The crusher device according to claim 10, wherein said at least one static element comprises one or several static blades fixed on the crusher driving device.

14. The crusher device according to claim 1, wherein said crusher device further comprises a torque detection device able to detect a predetermined high torque value of the crusher spindle, said torque detection device controlling the crusher driving device to adjust the rotation speed and/or rotation direction of the crusher spindle when the predetermined high torque value is detected.

15. A crusher device for performing a crushing operation, comprising:

a hollow part of frusto-conical shape narrowing downwardly, a crusher spindle rotatably mounted coaxial with the hollow part, at least one crusher impeller rotatably mounted on the crusher spindle, and a crusher driving device for rotatably driving said at least one crusher impeller relative to said first hollow part;

wherein said at least one crusher impeller comprises a first crusher impeller containing a first crushing blade and a second crushing blade, each said first and second crushing blades extending radially from the crusher spindle and being fixedly connected to each other at their distal extremities by a blade member, and wherein said first crusher impeller comprises a third crushing blade extending radially from the crusher spindle, below the first and second crushing blades.

16. A crusher device for performing a crushing operation, comprising:

a hollow part of frusto-conical shape narrowing downwardly, a crusher spindle rotatably mounted coaxial with the hollow part, at least one crusher impeller rotatably mounted on the crusher spindle, and a crusher driving device for rotatably driving said at least one crusher impeller relative to said first hollow part;

wherein said at least one crusher impeller comprises a first crusher impeller containing a first crushing blade and a second crushing blade, each said first and second crushing blades extending radially from the crusher spindle and being fixedly connected to each other at their distal extremities by a blade member, and wherein said first crusher impeller further comprises an unbalancing blade to impede the material lump rotating with the first impeller.

17. An assembly comprising:

a crusher device for performing a crushing operation, comprising a hollow part of frusto-conical shape narrowing downwardly, a crusher spindle rotatably mounted coaxial with the hollow part, at least one crusher impeller rotatably mounted on the crusher spindle, and a crusher driving device for rotatably driving said at least one crusher impeller relative to said first hollow part, wherein said at least one crusher impeller comprises a first crusher impeller containing a first crushing blade and a second crushing blade, each said first and second crushing blades extending radially from the crusher spindle and being fixedly connected to each other at their distal extremities by a blade member; and a milling device, wherein the crusher device and milling device are arranged such that material which has been crushed in a crushing operation performed by the crusher device may be passed directly from the crusher device to the milling device.

18. A crusher device for performing a crushing operation, comprising:

a hollow part of frusto-conical shape narrowing downwardly, a crusher spindle rotatably mounted coaxial with the hollow part, at least one crusher impeller rotatably mounted on the crusher spindle, and a crusher driving device for rotatably driving said at least one crusher impeller relative to said first hollow part;

wherein said at least one crusher impeller comprises a first crusher impeller containing a first crushing blade and a second crushing blade, each said first and second crushing blades extending radially from the crusher spindle and being fixedly connected to each other at their distal extremities by a blade member, wherein said crusher device further comprises a second crusher impeller, and wherein said second crusher impeller comprises an outer ring mounted rotatably and coaxially on the crusher spindle, said outer ring containing one or several outer crushing teeth along its periphery.

* * * * *